US005134441A

United States Patent [19]

Nagata et al.

[11] Patent Number: 5,134,441

[45] Date of Patent: Jul. 28, 1992

[54] DEVELOPING DEVICE AND PROCESS CARTRIDGE INCLUDING THE DEVICE

[75] Inventors: Tsunetoshi Nagata, Yokohama; Kazushi Kitajima, Kawasaki; Shinichi Sasaki, Fujisawa, all of Japan

[73] Assignee: Canon Kabushiki Kaisha, Tokyo, Japan

[21] Appl. No.: 522,815

[22] Filed: May 14, 1990

[30] Foreign Application Priority Data

May 30, 1989 [JP] Japan ..... 1-134760

[51] Int. Cl.[5] ..... G03G 15/06

[52] U.S. Cl. ..... 355/245; 118/653; 222/DIG. 1; 355/210; 355/215

[58] Field of Search ..... 355/246, 260, 200, 245; 222/DIG. 1; 366/309, 311; 118/693, 694, 689, 690, 692, 653

[56] References Cited

U.S. PATENT DOCUMENTS

| | | | |
|---|---|---|---|
| 4,931,838 | 6/1990 | Ban et al. | 355/260 |
| 4,947,211 | 8/1990 | Ono et al. | 355/265 |
| 4,993,829 | 2/1991 | Naganuma et al. | 355/251 |

*Primary Examiner*—R. L. Moses
*Assistant Examiner*—Christopher Horgan
*Attorney, Agent, or Firm*—Fitzpatrick, Cella, Harper & Scinto

[57] ABSTRACT

A rotatable stirring member for stirring a developer for conveying the developer is provided within a receptacle housing the developer. The stirring member can be subjected to elastically twisted deformation so that a shaft portion at the side of one end for receiving a rotation driving force can rotate in a phase which is advanced from that of a shaft portion at the side of another end.

16 Claims, 7 Drawing Sheets

DEVELOPING DEVICE AND PROCESS CARTRIDGE INCLUDING THE DEVICE

BACKGROUND OF THE INVENTION

1. Field of the Invention

This invention relates to a developing device used in an image forming apparatus, such as a copier, a laser-beam printer or the like, for forming an electrostatic latent image on an image carrying member and for developing the image. The invention also relates to a process cartridge including the developing device.

2. Description of the Related Art

Heretofore, when conveying toner from a toner receptacle housing a developer to a developing chamber, in a configuration as shown in FIG. 1, a toner receptacle 3 is situated at a position higher than a developing chamber 5 including a developing roller 6. Since toner T spontaneously drops into the developing chamber 5 by its own weight when a seal 20 is removed, it is not necessary to provide a toner stirring means within the toner receptacle 3. However, when the toner receptacle 3 is disposed at the same height as the developing chamber 5, as shown in FIG. 2, all the toner T within the toner receptacle 3 does not move to the developing chamber 5 merely by removing the seal 20. Hence, a toner stirring means 4 is disposed within the toner receptacle 3, and the toner is stirred by rotating the toner stirring means 4 to convey the toner to the developing chamber 5.

However, there exist the following problems in the conventional approach as described above. That is, if the toner becomes agglomerated due to various conditions, such as, vibration during the transportation of its receptacle, being undisturbed for a long period, temperature rise or the like, the load resistance of the agglomerated toner becomes large. As a result, a state arises in which the toner stirring means does not easily move. If a driving force is applied to the toner stirring means in this state, the following problems arise:

(1) A tooth-skipping phenomenon is produced between transmission gears which transmit a driving force to the toner stirring means.

(2) The load for a driving source (a motor) in the main body becomes excessive, which causes stoppage and breakdown of the driving source.

(3) The toner stirring means is plastically deformed due to the load of the agglomerated toner and a sliding contact member does not uniformly slidably contact the inner wall of the toner receptacle, and the toner is not sufficiently stirred and conveyed.

(4) The stirring means is deformed by a bending force applied thereto due to the load of the agglomerated toner, and the apparent total length of the stirring means in the axial direction becomes short. The stirring means is thereby detached from bearings or the like which support the stirring means, and the toner is not sufficiently stirred and conveyed.

The picture quality of the toner image thus deteriorates due to the problems as described above.

SUMMARY OF THE INVENTION

It is an object of the present invention to provide a developing device which can securely stir and convey developer even in an agglomerated state, and thus provide an excellent developed image.

It is another object of the present invention to provide a developing device which can be detachably mounted on the main body of an image forming apparatus, and which can securely stir and convey a developer housed in the device even if it is in an agglomerated state, and thus provide an excellent developed image.

It is still another object of the present invention to provide a process cartridge having an image carrying member and a developing device and capable of being detachably mounted on the main body of an image forming apparatus, and which can securely stir and convey a developer housed within the developing device even if it is in an agglomerated state, and thus provide an excellent developed image.

According to one aspect of the present invention a developing device is provided with a receptacle for housing a developer. A developer carrying member carries the developer and conveys it to a developing region for developing an electrostatic latent image. A stirring means stirs the developer within the receptacle. The stirring means comprises a stirring member and a support member. The stirring member comprises a first shaft portion, a second shaft portion rotatably supported by the support member, and a stirring portion supported by the first shaft portion and the second shaft portion. A drive transmission member is provided for transmitting a rotation driving force to the first shaft portion. The stirring member is an elastically deformable material that can twist under the rotation driving force if the developer resists stirring.

According to another aspect of the present invention a developing device, to be detachably mounted on a main body of an image forming apparatus, is provided with a receptacle for housing a developer. A developer carrying member carries the developer and conveys it to a developer region for developing an electrostatic latent image. A stirring means stirs the developer within the receptacle. The developing means comprises a stirring member and a support member. The stirring member comprises a first shaft portion, a second shaft portion rotatably supported by the support member and a stirring portion supported by the first shaft portion and the second shaft portion. A drive transmission member is provided for transmitting a rotation driving force to the first shaft portion. The drive transmission member receives a driving force from a drive provision means within the main body of the image forming apparatus in a state in which the developing device is mounted within the main body of the image forming apparatus. The stirring member is an elastically deformable material that can twist under the rotation driving force if the developer resists stirring.

According to a further object of the invention a process cartridge, to be detachably mounted on a main body of an image forming apparatus, is provided with an image carrying member for forming an electrostatic latent image. A developing means develops the electrostatic latent image. The developing means comprises a receptacle for housing a developer. A developer carrying member is provided for carrying the developer and for conveying it to a developing region for developing an electrostatic latent image. A stirring means stirs the developer within the receptacle. The stirring means comprises a stirring member and a support member. The stirring member comprises a first shaft portion, a second shaft portion rotatably supported by the support member and a stirring portion supported by the first shaft portion and the second shaft portion. A drive transmission member is further provided for transmitting a rotation driving force to the first shaft portion. The stirring member is an elastically deformable material that can twist under the rotation driving force if the developer resists stirring.

These and other objects and features of the present invention will become more apparent from the following description.

DESCRIPTION OF THE PREFERRED EMBODIMENTS

A preferred embodiment of the present invention will now be explained with reference to FIG. 3.

Figure 1:
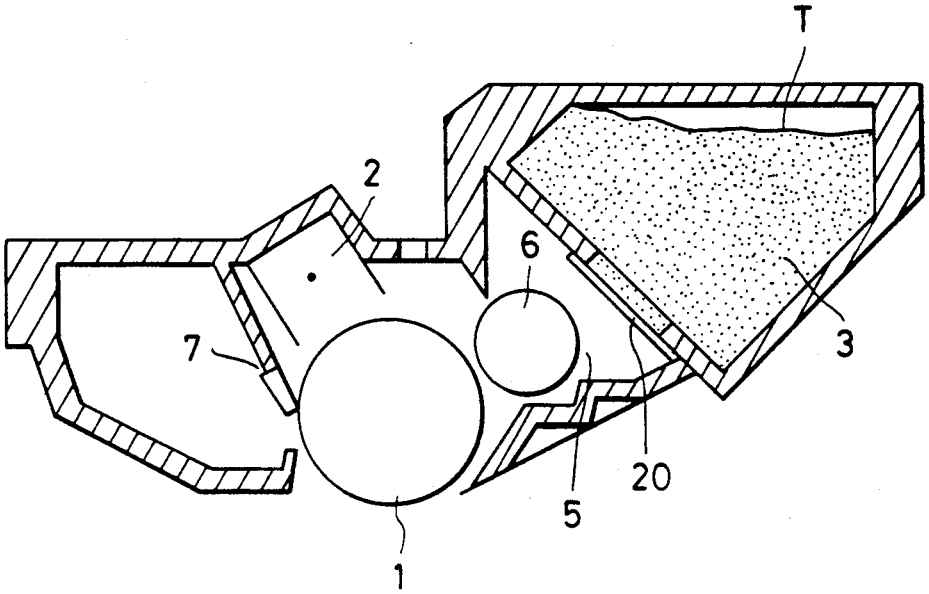
FIG. 1 (PRIOR ART)
FIG. 1 is a cross-sectional view of a conventional process cartridge.
Figure 2:
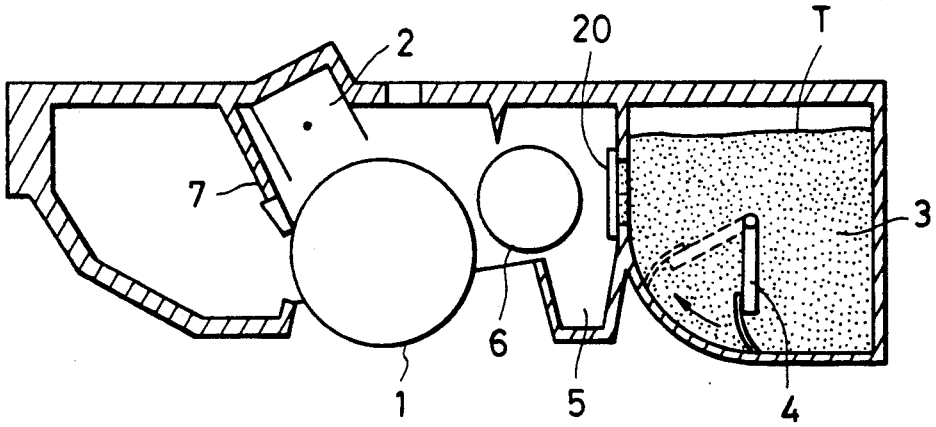
FIG. 2 (PRIOR ART)
FIG. 2 is a cross-sectional view of another conventional process cartridge.
Figure 3:
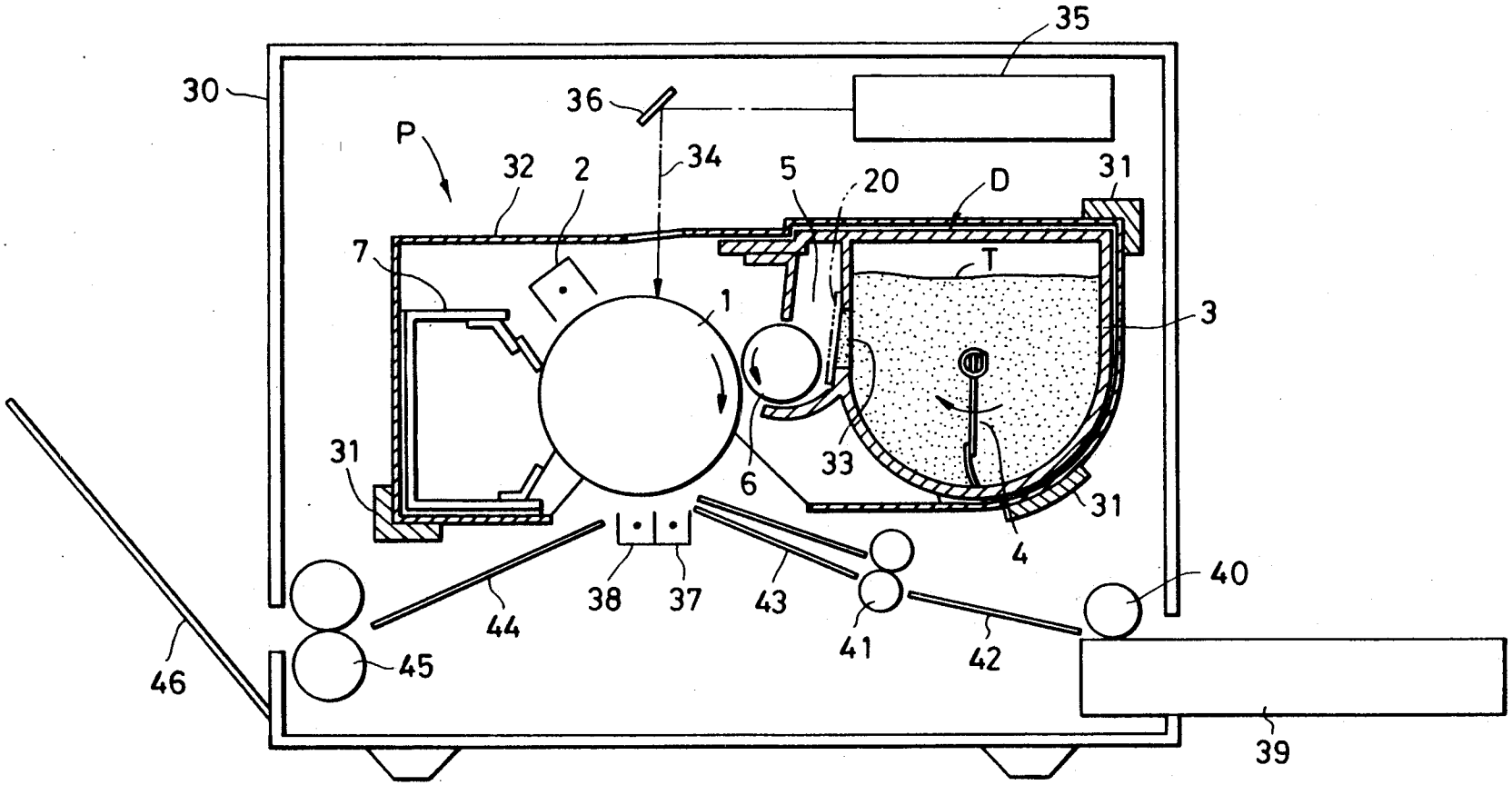
FIG. 3 is a cross-sectional view of an electrophotographic apparatus mounting a process cartridge having a developing device to which the present invention can be applied.

In FIG. 3, a main body 30 of an image forming apparatus includes an optical unit 35, a transfer material conveying unit, a transfer unit, a fixing unit 45, and a guide member 31 for guiding the mounting and detaching operations of a process cartridge P relative to the main body 30.

The process cartridge P includes an electrophotographic photosensitive member 1, rotating in the direction of the arrow, a charger 2, for uniformly charging the photosensitive member 1, a developing unit D for developing an electrostatic latent image formed on the photosensitive member 1, and a cleaning unit 7 for removing toner remaining on the surface of the photosensitive member 1 after the transfer of a developed image. These means are supported within a frame 32. The process cartridge P slides along the guide member 31, and is housed in and detached from the main body 30. Accordingly, when, for example, the toner within the developing unit D is used up, the process cartridge P is taken out of the main body 30 by the operator, and the operator can mount a new process cartridge P having a developing unit D previously filled with toner into the main body 30 in place of the old process cartridge. Furthermore, by mounting a process cartridge P which houses the toner having a desired color within the main body, it is possible to output an image having the desired color.

The developing unit D includes a toner receptacle housing toner T, a stirring member 4 rotatably provided within the receptacle 3, a developing chamber 5, and a developing roller 6 provided in the developing chamber 5.

The stirring member 4 rotates in the direction of the arrow to stir the toner T within the receptacle 3, and conveys the toner to the developing chamber 5 through an opening 33 provided in a wall of the receptacle 3. The developing roller 6 carries the toner conveyed to the developing chamber 5, and rotates in the direction of the arrow to convey the toner to a developing region for developing an electrostatic latent image formed on the photosensitive member 1.

In an unused process cartridge P, a seal member 20 is adhered on a side wall of the receptacle 3 to seal the opening 33. The seal member 20 thus prevents the toner from escaping outside the receptacle 3, which may stain the inside and the outside of the cartridge. The seal member 20 also prevents the unnecessary waste of toner. When a new cartridge P is started, the operator removes the seal member 20 from the position of the opening 33 to open the opening 33 either before or after loading the cartridge P within the main body 30. It is thereby possible to set a state in which the toner T can move from the receptacle 3 to the developing chamber 5. The seal member may also openably seal an opening of the developing chamber 5 having the roller 6.

The image forming operation will now be explained. The photosensitive member 1 is first charged by the charger 2, and is then scanned and exposed by a laser beam 34 modulated in accordance with a signal representing image information to be recorded to form an electrostatic latent image. The laser beam 34 is formed by a known optical unit 35 including a semiconductor laser, a rotating polygon mirror, a f-0 lines and the like, and is reflected in the direction of the photosensitive member 1 by a mirror 36.

The above-described latent image is developed by the developing unit D as described before. The toner image thereby obtained is transferred to a transfer material, such as paper or the like, by the function of a transfer charger 37. The transfer material is then separated from the photosensitive member 1 by the function of a charge remover 38 for separation.

The unit for conveying the transfer material includes a cassette 39 housing the transfer materials, a pickup roller 40 for sending out the transfer material from the cassette 39, registration rollers 41 for conveying the transfer material to a transfer region at the member 1 in synchronization with the movement of the member 1, and conveying guides 42, 43 and 44.

The transfer material separated from the photosensitive member 1 is sent to a fixing unit 45 via the guide 44. The toner image is fixed on the transfer material in the fixing unit 45. The transfer material after the fixing operation is discharged onto a tray 46.

Although the laser beam is exposed onto the photosensitive member 1 in the illustrated example, the photosensitive member 1 may also be exposed by the emission light from an LED (light-emitting diode) array driven by an image signal, or the photosensitive member 1 may be directly exposed by an image of an original via a lens.

Figure 4:
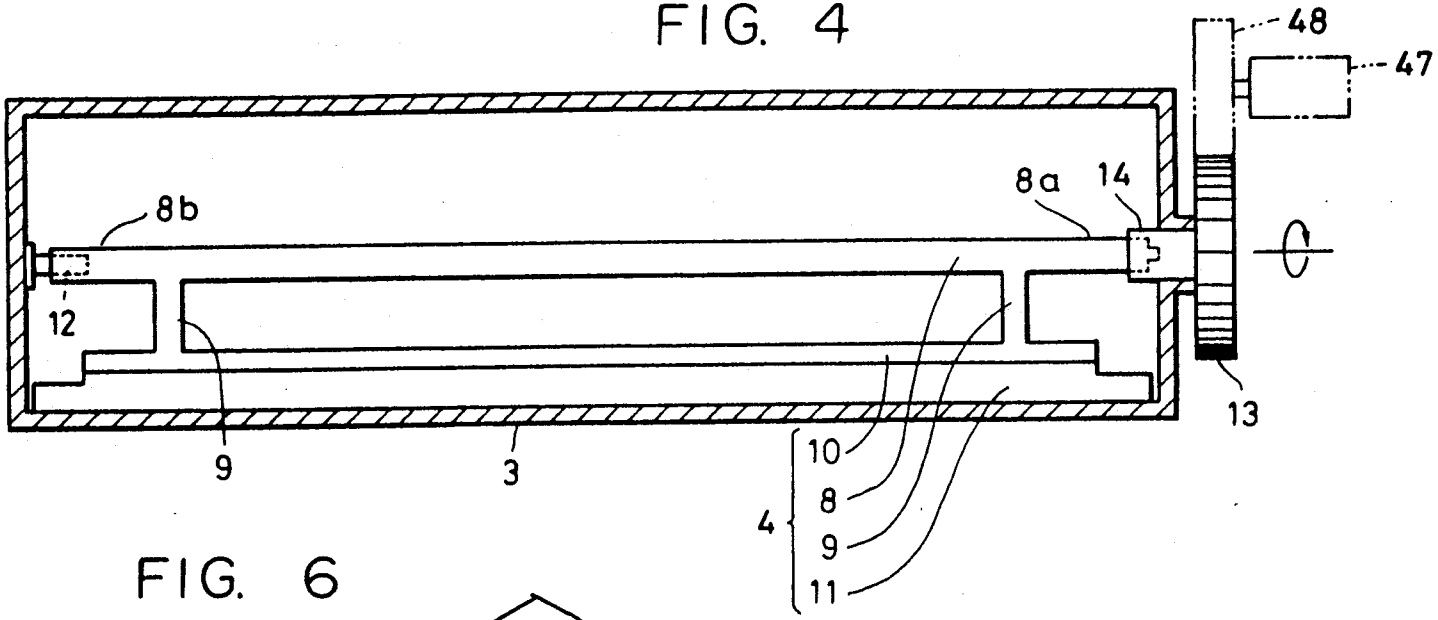
FIG. 4 is a cross-sectional view of the entire structure of a stirring member.
Figure 5:
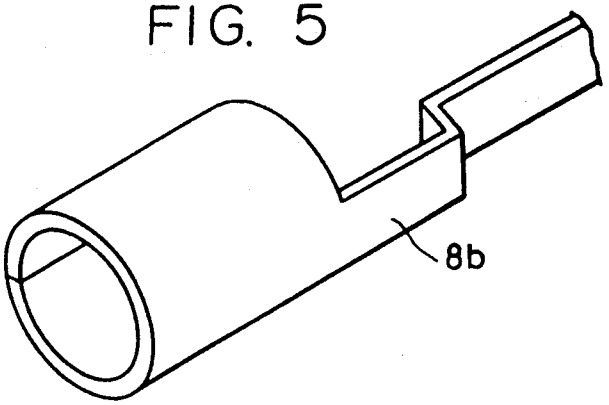
FIG. 5 is a perspective view of a second shaft portion of the stirring member.

As shown in FIG. 4, the stirring member 4 includes a shaft 8, two arms 9 projecting radially from the shaft 8 proximate to the ends thereof, a first shaft portion 8*a* at one end of the shaft 8, a second shaft portion 8*b* at the other end of the shaft 8, a bar 10 connecting the ends of the two arms 9, and an elastic film 11. Film 11 is made, for example, of plastic, rubber or the like, and is fixed to the bar 10. Film 11 is arranged to slidably contact the inner surface of the receptacle 3. The bar 10 and the film 11 principally stir and convey the toner. In the present embodiment, the members 8, 9 and 10 are made by cutting a elastically deformable metal plate made, for example, of thin stainless steel (SUS304CSP·H) by press cutting processing or the like, and are formed as one body. The stirring member is flat except an end portion of the second shaft portion 8*b* which is formed in the shape of a ring, as shown in FIG. 5. The members 8, 9 and 10 may also be formed by an elastically deformable material made of plastic, such as polyethylene terephthalate or the like.

A shaft 14 to which a gear 13 is fixed is rotatably supported on the receptacle 3. When the process cartridge P is mounted within the main body 30, the gear 13 meshes with a gear 48 of a driving means which includes a driving means provided within the main body 30, that is, a motor 47 and the gear 48 for transmitting the output of the motor 47. The gear 13 thus rotatably drives the stirring member 4 within the receptacle 3 through the rotation driving force of the motor 47.

Figure 6:
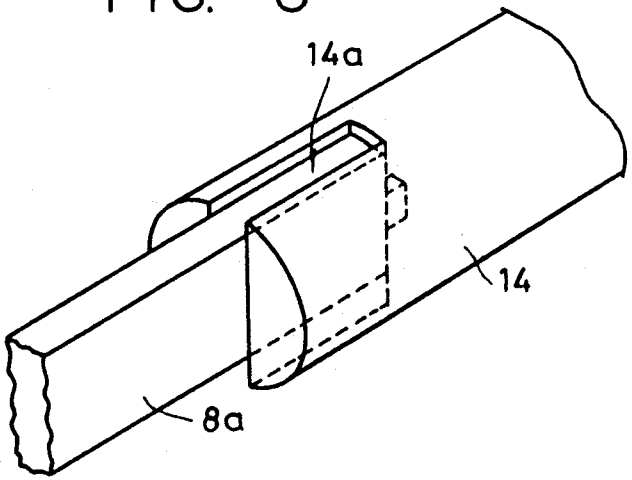
FIG. 6 is a perspective view of a first shaft portion of the stirring member.

As shown in FIG. 6, a groove 14*a* is formed in the direction of the diameter in the shaft 14. The first shaft portion 8*a* of the shaft 8 is inserted within the groove 14*a*, and is thereby fixed to the shaft 14 relative to the direction of the rotation of the shaft 14, that is, the direction of the rotation of the shaft 8.

As shown in FIG. 5, the second shaft portion 8*b* of the shaft 8 is configured in the shape of a cylinder. The cylindrical portion is loosely fitted with a columnar support member 12 fixed to the receptacle 3. Accordingly, the second shaft portion 8*b* is rotatable relative to the support member 12 and displacable in the longitudinal direction of the shaft.

In the above-described configuration, when a rotation driving force is provided for the gear 13 to rotatably drive the stirring member 4 around the axis, a large amount of load is applied to the stirring member 8 from the toner, if, for example, a large amount of toner exists within the receptacle 3, or the toner is in a agglomerated state. At this moment, the stirring member 4 is subjected to elastically twisted deformation relative to the axis so that the second shaft portion 8*b* can rotate having a phase delay from the first shaft portion 8*a*.

Figure 7:
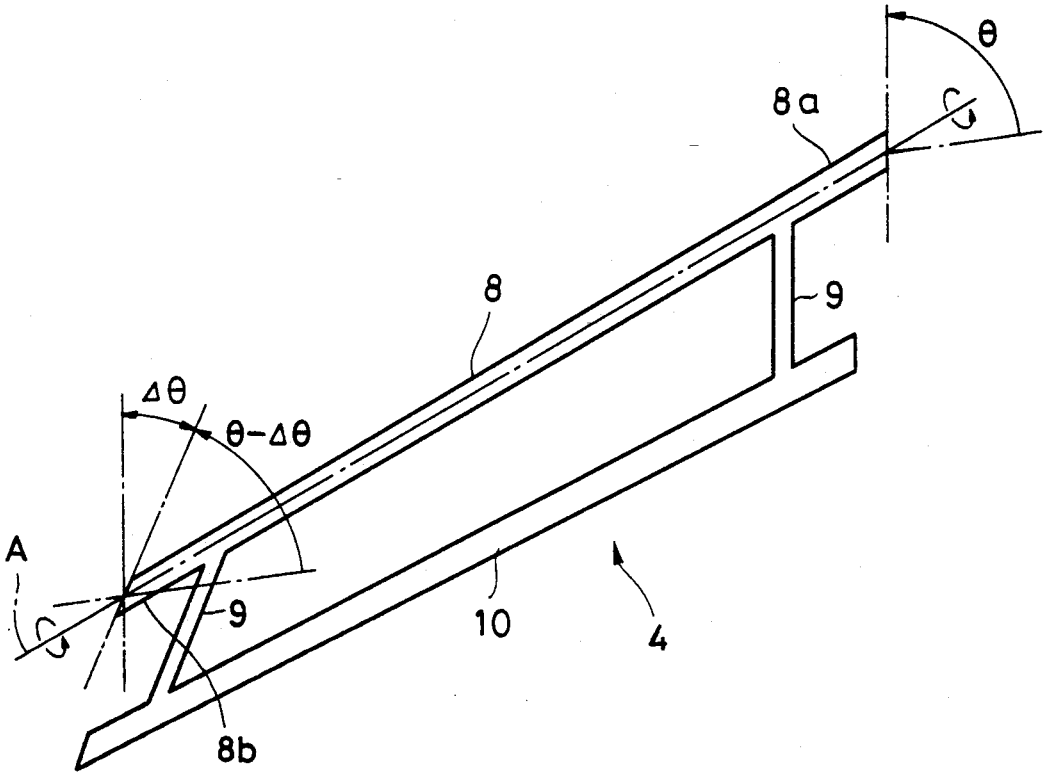
FIG. 7 is a diagram illustrating twisted deformation of the stirring member.

That is, as shown in FIG. 7, when the first shaft portion 8*a* is provided with a rotation driving force in the direction of the arrow by the gear 13, the stirring member 4 is subjected to elastically twisted deformation around the axis A due to the load resistance of the toner applied to the bar 10, the arm 9 and the like. Accordingly, while the first shaft portion 8*a* at the side where the rotation driving force is provided rotates by an angle $\theta$, the second shaft portion 8*b*, which is merely rotatably supported by the support member 12, rotates by an angle which is smaller than the angle $\theta$ by an angle $\Delta\theta$, that is, by an angle $(\theta-\Delta\theta)$. That is, the entire portion over the whole length of the stirring member 4 does not rotate by the same angle at the same moment. To the contrary, the side of the second shaft portion 8*b* rotates slower than the side of the first shaft portion 8*a*.

Figure 8:
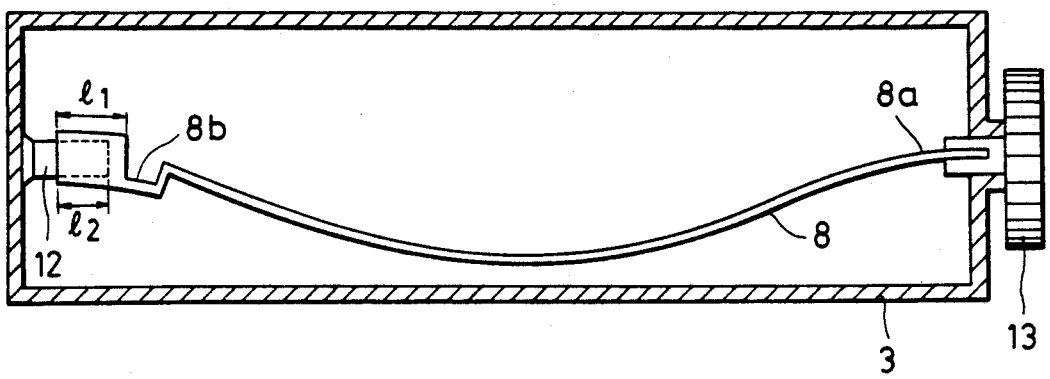
FIG. 8 is a diagram illustrating bent deformation of the stirring member.
Figure 9:
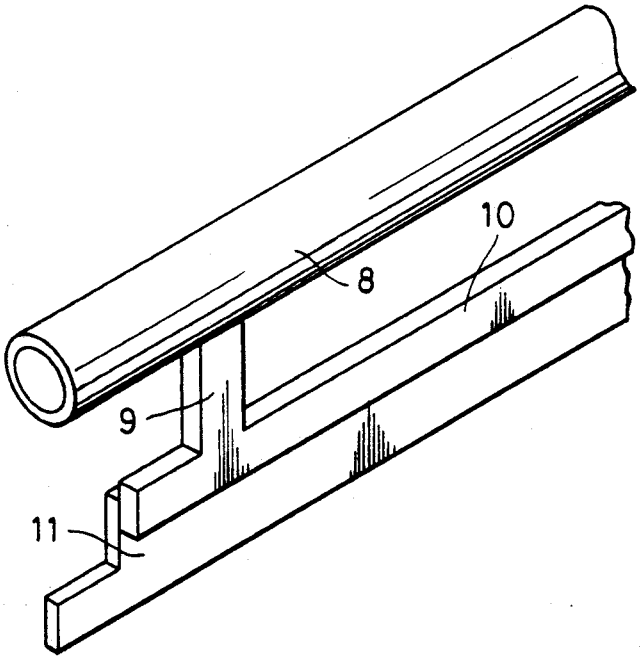
FIG. 9 is a perspective view of another example of the stirring member.
Figure 10:
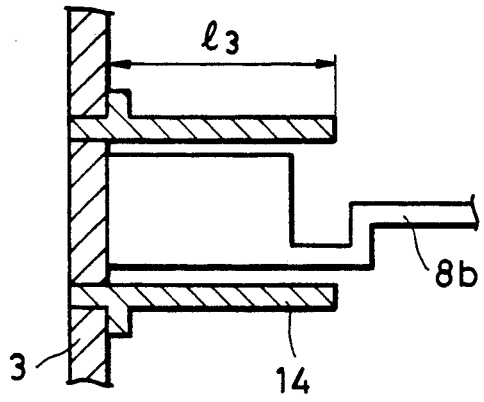
FIG. 10 is a cross-sectional view of a support means for the second shaft portion of the stirring member.
Figure 11:
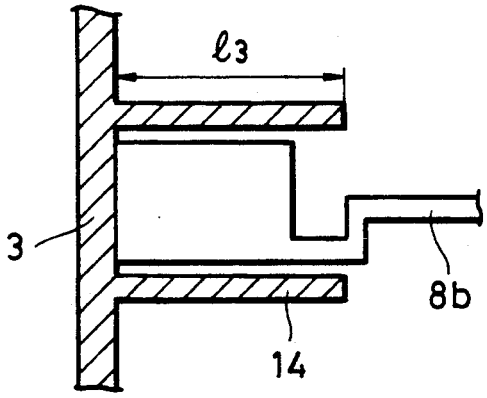
FIG. 11 is a cross-sectional view of another support means for the second shaft portion of the stirring member.

Accordingly, the load applied to the driving shaft 14 is reduced, and no trouble occurs in the driving source 47, the gears 13 and 48, and the like. Furthermore, since the stirring member 4 is restored without being plastically deformed because it is made of an elastic material, the sheet member 11 uniformly slidably contacts the inner wall surface of the receptacle 3 housing the developer. Even if the stirring member 4 is subjected to elastic deformation due to being bent during rotation, as shown in FIG. 8, and the second shaft portion 8*b* at the side of the columnar support member 12 is thereby drawn in the direction of the shaft toward the driving shaft 13, the stirring member 4 is not detached from the columnar support member 12 because its cylindrical end portion is slidably supported by the columnar support member 12 with a depth $1_1$. Aside from the configuration of the present embodiment, the entire portion of the shaft 8 may be formed in the shape of a tube made, for example, of plastic (such as ABS resin containing glass fibers or the like) which can be subjected to elastically twisted deformation, as in an embodiment shown in FIG. 9. Furthermore, as in an embodiment shown in FIG. 10, a tubular bearing member 14 having a depth of $1_3$ may be disposed on the receptacle 3 in place of the columnar support member 12, and the second shaft portion 8*b* may be inserted therein so as to slidably contact the member 12 in the direction of rotation and the direction of the axis. Similarly, as in an embodiment shown in FIG. 11, the bearing member 14 may be formed as one body with the receptacle 3 for the developer.

Although it is preferred that the sheet member 11 of the stirring member 4 slidably contacts at least the inner surface of the base of the receptacle 3, from the viewpoint of scooping and conveying the toner adhered to the inner surface of the receptacle 3, it is not an indispensable condition. A small gap may be formed between the sheet material 11 and the receptacle 3. Furthermore, a coil spring may be provided in place of the sheet member 11, or these members may be omitted.

Moreover, the members 8, 9, 10 and the like may not have plate-like shapes as described above, but they may be configured utilizing fine piano wires or other equivalent structure.

In FIG. 3, the process cartridge P including the photosensitive member is detachably mounted on the main body 30. However, the present invention may also be applied to the developing unit D when the developing unit D is detachably mounted on the main body 30 of the image forming apparatus independently from other process means, such as the photosensitive member 1 and the like, as shown in FIG. 12.

Figure 12:
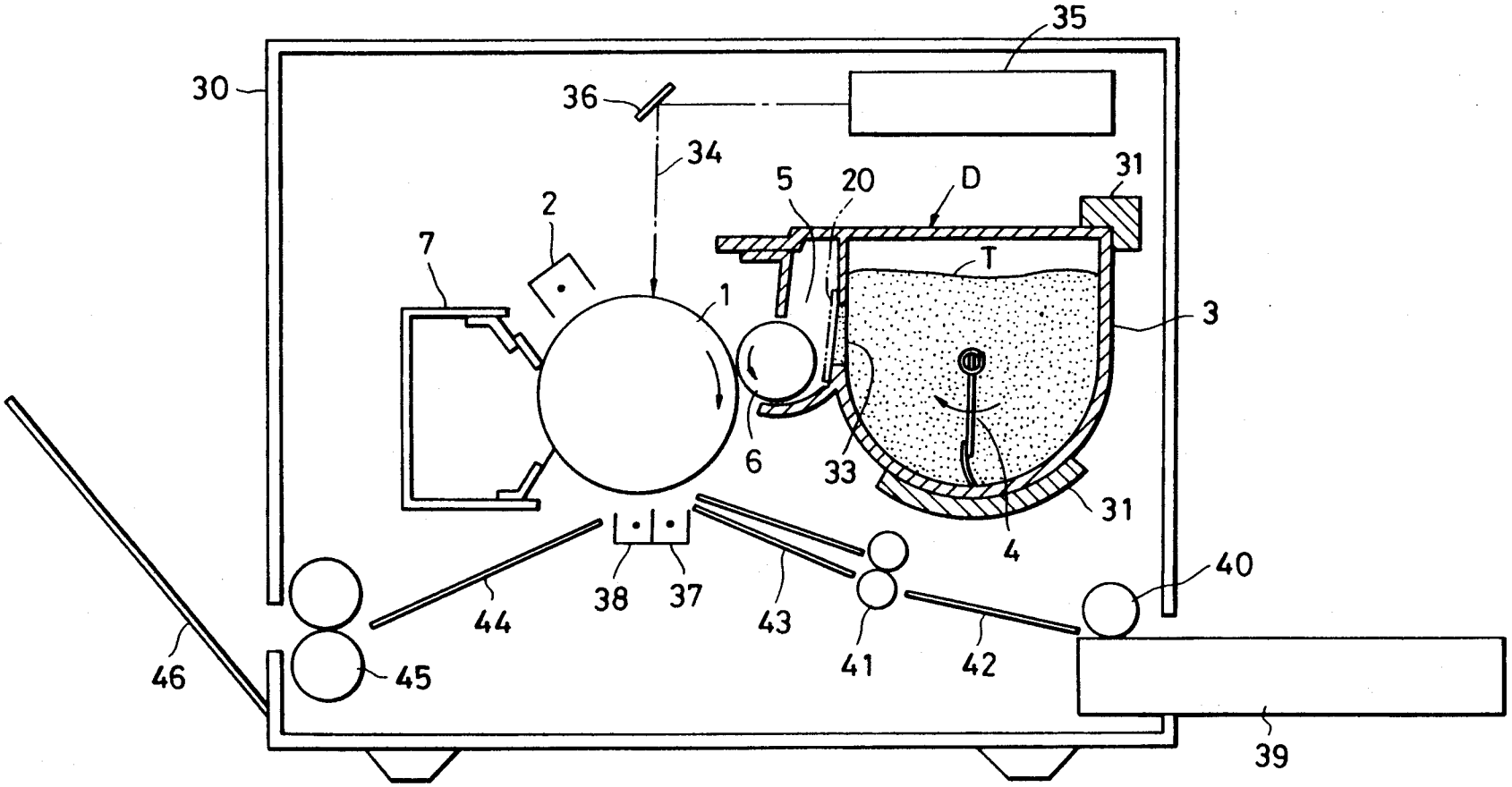
FIG. 12 is a cross-sectional view of another electrophotographic apparatus mounting a developing device to which the present invention can be applied.

In FIG. 12, members and means having the same functions as those shown in FIG. 3 are indicated by like numerals, and an explanation of the operation of respective members and means will be omitted.

In FIG. 12, unlike in FIG. 3, the developing unit D can be mounted on or detached from the main body 30 of the image forming apparatus by being slidably guided by a guide 31 independently from the photosensitive member 1 and the like. Hence, when, for example, the toner within the developing unit D is used up, the developing unit D is taken out of the main body 30 by the operator, and a new developing unit D having the toner previously filled within the receptacle 3 can be mounted within the main body 30 by the operator in place of the old one. Furthermore, by mounting a developing unit D housing the toner having a desired color within the main body 30, it is possible to form a developed image having the desired color.

Since the developing unit D shown in FIG. 12 may have the same configuration as that already described with reference to FIGS. 3 through 11, a repeated explanation thereof will be omitted.

The present invention may be applied not only to an electrophotographic-type image forming apparatus, but also to a developing device of an image forming apparatus which forms an electrostatic latent image on an image carrying member by an ion current or the like modulated by an image signal.

Furthermore, although an explanation has been provided of a case in which a single-component developer is used, the present invention may also be applied to a developing device utilizing a two-component developer.

What is claimed is:

1. A developing device comprising:

a receptacle for housing a developer;

a developer carrying member for carrying the developer and for conveying it to a developing region for developing an electrostatic latent image;

stirring means for stirring the developer within said receptacle, said stirring means comprising a support member and a stirring member having a first shaft portion, a second shaft portion rotatably supported by said support member, and a stirring portion supported by said first shaft portion and said second shaft portion; and a drive transmission member for transmitting a rotation driving force to said first shaft portion, wherein said stirring member is an elastically deformable material such that said first shaft portion can twist relative to said second shaft portion under the rotation driving force if the developer resists stirring.

2. A developing device according to claim 1, wherein said stirring member comprises a first arm portion provided at the first shaft portion and a second arm portion provided at the second shaft portion, and wherein the stirring portion connects the first arm portion to said second arm portion.

3. A developing device according to claim 1, wherein said stirring portion slidably contacts an inner surface of said receptacle.

4. A developing device according to claim 1, 2 or 3, wherein said second shaft portion is displacably supported in a longitudinal direction by said support member.

5. A developing device to be detachably mounted on a main body of an image forming apparatus, said device comprising:

a receptacle for housing a developer;

a developer carrying member for carrying the developer and for conveying it to a developing region for developing an electrostatic latent image;

stirring means for stirring the developer within said receptacle, said stirring member comprising a support member and a stirring member having a first shaft portion, a second shaft portion rotatably supported by said support member and a stirring portion supported by said first shaft portion and said second shaft portion; and a drive transmission member for transmitting a rotation driving force to said first shaft portion, said drive transmission member receiving a driving force from drive provision means within the main body of the image forming apparatus when the developing device is mounted within the main body of the image forming apparatus, wherein said stirring member is an elastically deformable material such that said first shaft portion can twist relative to said second shaft portion under the rotation driving force if the developer resists stirring.

6. A developing device according to claim 5, wherein said stirring member comprises a first arm portion provided at said first shaft portion and a second arm portion provided at said second shaft portion, and wherein said stirring portion connects said first arm portion to said second arm portion.

7. A developing device according to claim 5, wherein said stirring portion slidably contacts an inner surface of said receptacle.

8. A developing device according to claim 5, 6 or 7, wherein said second shaft portion is displacably supported in a longitudinal direction by said support member.

9. A developing device according to claim 5, 6 or 7, further comprising a seal member for preventing the developer from escaping from the developing device, wherein said seal member is opened before starting to use the developing device.

10. A developing device according to claim 8, further comprising a seal member for preventing the developer from escaping from the developing device, wherein said seal member is opened before starting to use the developing device.

11. A process cartridge to be detachably mounted on a main body of an image forming apparatus, said cartridge comprising:

an image carrying member for forming an electrostatic latent image;

developing means for developing said electrostatic latent image, said developing means comprising:

a receptacle for housing a developer;

a developer carrying member for carrying the developer and a for conveying it to a developing region for developing an electrostatic latent image;

stirring means for stirring the developer within said receptacle, said stirring means comprising a support member and a stirring member having a first shaft portion, a second shaft portion rotatably supported by said support member and a stirring portion supported by said first shaft portion and said second shaft portion; and a drive transmission member for transmitting a rotation driving force to the first shaft portion, wherein said stirring member is an elastically deformable material such that said first shaft portion can twist relative to said second shaft portion under the rotation driving force if the developer resists stirring.

12. A process cartridge according to claim 11, wherein said stirring member comprises a first arm portion provided at said first shaft portion and a second arm portion provided at said second shaft portion, and wherein said stirring portion connects said first arm portion to said second arm portion.

13. A process cartridge according to claim 11, wherein said stirring portion slidably contacts an inner surface of said receptacle.

14. A process cartridge according to claim 11, 12 or 13, wherein said second shaft portion is displacably supported in a longitudinal direction by said support member.

15. A process cartridge according to claim 11, 12 or 13, further comprising a seal member for preventing the developer from escaping from said receptacle, wherein said seal member is opened before starting to use the process cartridge.

16. A process cartridge according to claim 14, further comprising a seal member for preventing the developer from escaping from said receptacle, wherein said seal member is opened before starting to use the process cartridge.

* * * * *

UNITED STATES PATENT AND TRADEMARK OFFICE

CERTIFICATE OF CORRECTION

PATENT NO. : 5,134,441

DATED : July 28, 1992

INVENTOR(S) : Nagata et al.

It is certified that error appears in the above-identified patent and that said Letters Patent is hereby corrected as shown below:

COLUMN 8:

Line 38, "a" should be deleted--; and

Line 48, "the" should read --said--.

Signed and Sealed this

First Day of February, 1994

Bruce Lehman

*Attest:*

BRUCE LEHMAN

*Attesting Officer*

*Commissioner of Patents and Trademarks*